United States Patent [19]

Nakajima et al.

[11] Patent Number: 5,052,479

[45] Date of Patent: Oct. 1, 1991

[54] TUBE FOR COOLANT CONDENSER

[75] Inventors: Ichio Nakajima; Tsuneo Kousaka; Yoshihito Takagi, all of Isezaki, Japan

[73] Assignee: Yuugen Kaisha Marunaka Seisakusho, Gunma, Japan

[21] Appl. No.: 517,354

[22] Filed: May 1, 1990

[30] Foreign Application Priority Data

Jun. 29, 1989 [JP] Japan ..... 1-76463
Nov. 4, 1989 [JP] Japan ..... 1-129210[U]

[51] Int. Cl.[5] ..... F28D 1/02
[52] U.S. Cl. ..... 165/153; 165/173
[58] Field of Search ..... 165/173, 176, 153

[56] References Cited

U.S. PATENT DOCUMENTS 4,936,379 6/1990 Hoshino et al. ..... 165/176

*Primary Examiner*—Ronald C. Capossela
*Attorney, Agent, or Firm*—Bauer & Schaffer

[57] ABSTRACT

The flat tubular heat exchange body is provided with shoulders on each of its peripheral side walls at a fixed distance from each end. The ends of the bodies is shaped and sized to fit into a slot in a header pipe so that when the shoulders strike the surface of the header pipe, the invention is automatically fixed.

8 Claims, 4 Drawing Sheets

TUBE FOR COOLANT CONDENSER

FIELD OF THE INVENTION

This invention relates to the construction of a header pipe for a coolant condenser used, for example, in automobile air conditioners.

PRIOR ART

The general construction of the known coolant condenser is illustrated in FIGS. 6 and 7. In this coolant condenser, similarly formed header pipes A and C, partitioned in the longitudinal direction by partitioning plates E, support a plurality of heat exchange tubes B. Coolant supplied from the left header pipe A is led to the upper set of three tubes B, thence to the right header pipe C into the intermediate set of three tubes B, from which it is eventually returned to pipe A, for exit through the lower set of three tubes B and pipe C.

In this manner, the coolant flows in a meandering and sinuous fashion through a plurality of tubes under pressure and is caused to undergo forced heat radiation, becoming cooled liquid at low temperature and high pressure. Heat radiated at this time is transmitted from tubes B to corrugated fins D provided between adjacent tubes B to be thereby dissipated to the outside by air moved over the corrugated fins D.

To insert the tubes B properly into the header pipes A and C, which have been preformed with receiving slots F, a semi-cylindrical positioning block G, as shown in FIG. 8, is first inserted into the respective pipe body. Thereafter, tubes B are inserted into the slots F until they strike the block G, thus determining the insertion length L (FIG. 8) of tube B. Subsequently, the positioning block G is withdrawn from each of pipes A and C, and pipes A and C are secured to the tubes B by soldering.

PROBLEMS IN THE PRIOR ART

The above method of positioning tubes B have the following problems:

1) It is necessary to prepare positioning blocks G, leading to increased tooling costs, thereby rendering the manufacture uneconomical.

2) Positioning blocks G have to be manually inserted into and withdrawn from each header pipes A and C, a cumbersome addition to the manufacturing operation.

3) If the positioning block G from the pipes while the tubes B are still in contact with the block G, the tube ends are liable to be shifted and deviated from the desired position.

4) Until soldered, the tubes B are liable to shift out of place, even after withdrawal of the positioning blocks G.

5) If the insertion length L of the tubes B (FIG. 8) is varied due to any deviation, the resistance offered to the flow of coolant in pipes A and C will be varied, and coolant will flow into tubes B nonuniformly, resulting in fluctuation in the rate of flow of coolant, distabilizing cooling efficiency, and making it impossible to obtain sufficient cooling.

OBJECT OF THE INVENTION

An object of the invention is to provide heat exchange in the tube itself insertion limiting means so that it establishes a fixed insertion length into the header pipe, whereby less deviation and variation in the insertion length is obtained even while it is unsoldered, thus ensuring ultimate steady flow of coolant through the tube and header pipe.it.

SUMMARY OF THE INVENTION

According to the invention, the known coolant condensers are improved by providing heat exchange tubes which, as shown in FIGS. 1–3, comprise a body 1 having at each end a predetermined length insertion end 6 terminating in the peripheral edge 2 formed with outwardly projecting shoulders 3 which form stop means regulating the length L by which the tube B is inserted into the header pipe A (FIG. 5). In the embodiments of FIGS. 1 and 2 this is accomplished by providing rod-like members along the central length of the peripheral edge 2 while in the embodiment of FIG. 3 a projecting boss is formed at the edge.

In one form of the invention the heat exchange tube, as shown in FIG. 4, has its peripheral edge 2 cut back at its ends to form flat lands 4, making the ends transversely narrower than the remainder 7 of the body 1. The lands 4 provide guides by which the heat exchange tube can be inserted into the slots F while the shoulders 3 defined by the lands 4 limit the extent of such insertion.

DETAILED DESCRIPTION OF THE INVENTION

Figure 1:
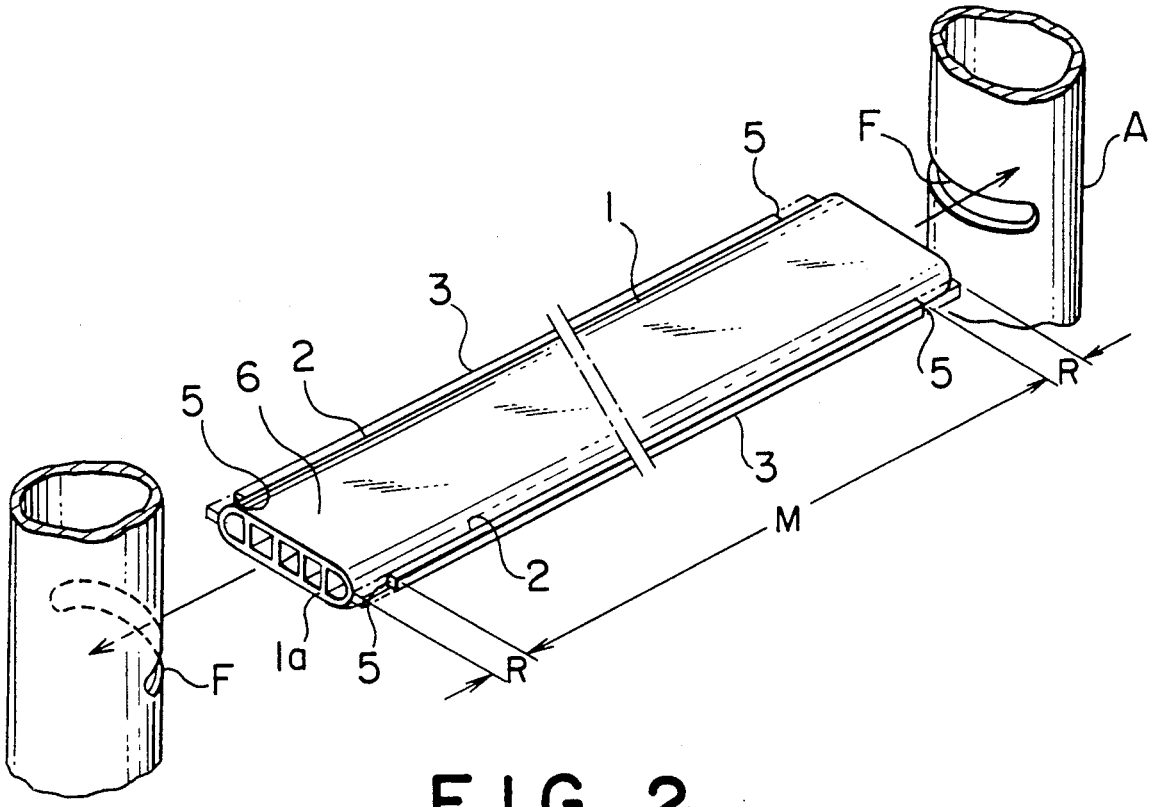
FIG. 1 is an exploded perspective view partially in section, showing the heat exchange tube for a coolant condenser embodying the present invention.

Referring to FIGS. 1–4, reference numeral 1 designates the heat exchange tube body. The illustrated body 1 is made of an extruded or molded metal and is flattened in shape, providing a peripheral edge 2 along each side edge, flat top, and bottom surfaces and end portions 6 adapted to fit into the slot F of either header pipes A (both left and right). The peripheral edge 2 of each tube body 1 is formed with a shoulder 3 projecting outwardly beyond the extent of the end portion 6 to limit the extent of insertion into the header pipe.

In the instance of FIG. 1, the shoulder 3 is formed at the end of an elongate, ridge-like lateral extension 5 situated along each of the peripheral edges 2 (on opposite sides of tube body 1) and centrally between the end portions 6 so as to enlarge the width of the body. Preferably, the lateral extensions 5 are initially formed integrally with tube body 1 over the entire length thereof during the extrusion of the heat exchange tube. Afterwards, the tip ends of the extensions 5 are removed for a length R equal to the end portions 6 (shown by phantom lines in FIG. 1), beginning from the frontal ends la of tube body 1 and in the longitudinal direction. The length R is such that body 1 is capable of being inserted for a predetermined length L (FIG. 5) so that when the end portion 6 is fully inserted into the slot F, the shoulder 3 strikes the header pipe surface about outer periphery of the slot F.

Instead of integrally forming the extension 5 with the body, it is possible, by soldering or otherwise, to fixedly attach separate angular bars having a length M equal to the desired length of the extensions 5 to each of the peripheral walls 2 of the body 1.

Figure 2:
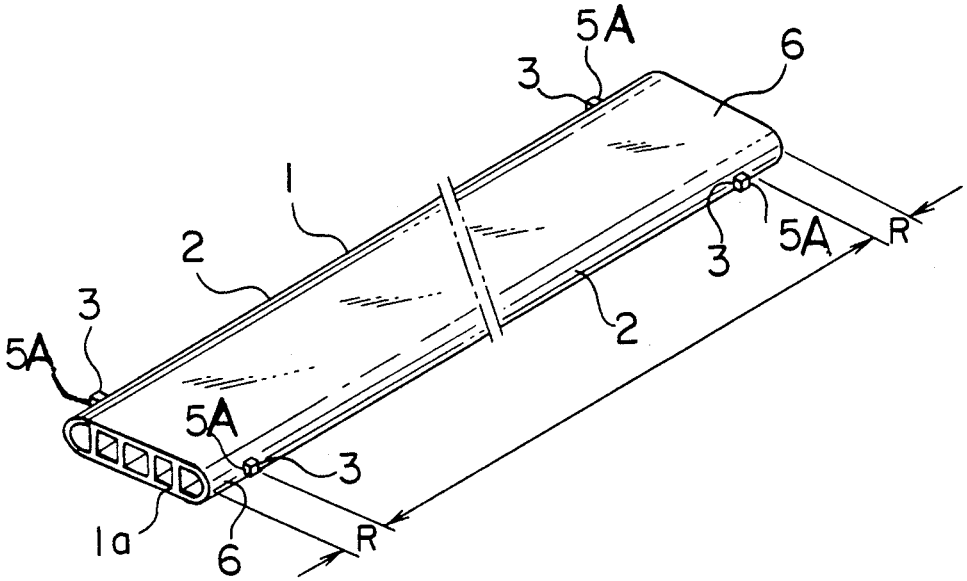
FIG. 2 is a perspective view of the heat exchange tube shown in FIG. 1.

In FIG. 2 a different embodiment is shown wherein the shoulders 3 are formed of short lateral projection bosses 5*a* integrally formed with the body when molding the heat exchange tube body 1. The distance R from shoulder 3 to the corresponding end 1*a* of body 1 is equal to length R of the end portion 6 shown in FIG. 1.

Figure 3:
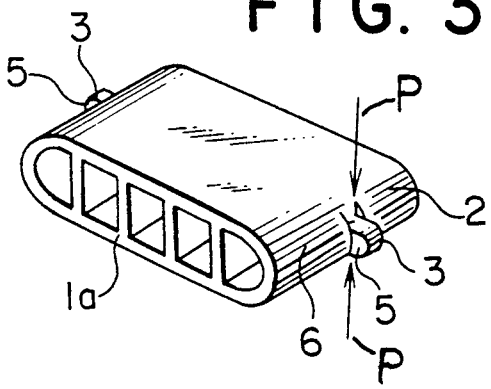
FIG. 3 is an enlarged perspective view of the end of the heat exchange tube shown in FIG. 2.

In a further alternative illustrated in FIG. 3, it is possible to form the shoulders 3 by forcing or stamping out the material of the peripheral edge 2 of tube body 1 in the direction of the arrows P in FIG. 3.

It is also possible to form the shoulders 3 by other methods than those described hereinbefore. For instance, the material in the wall of the peripheral edge 2 of tube body 1 may be forced outwardly by bulge processing. It is also possible to provide shoulders 3 only on one side of peripheral edge 2 of tube body 1.

Figure 4:
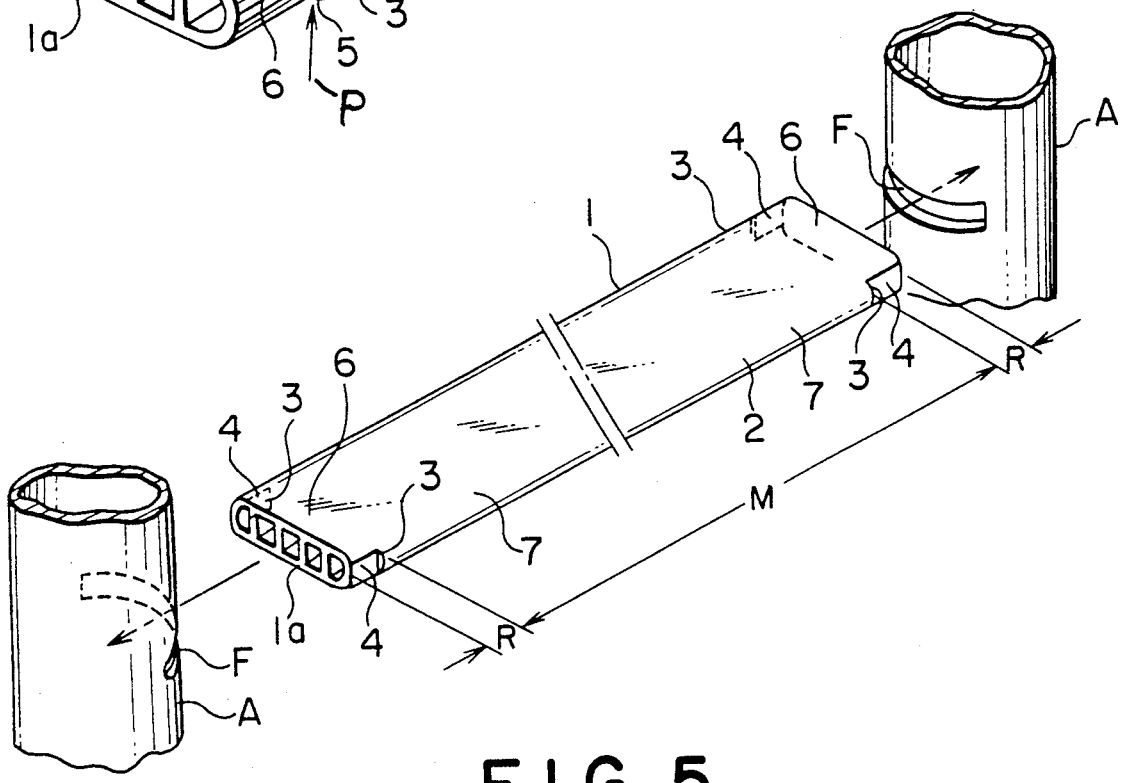
FIG. 4 is a view similar to FIG. 1, showing another form of heat exchange tube according to the present invention.

FIG. 4 shows a further embodiment of the invention. In this instance, the body 1 is formed with flat lands 4 on opposite sides of the peripheral edge 2 along the insertion end 6. The lands 4 act as guides on the opposite sides of the body terminating at the inner end at the shoulders 3. The length R of lands 4 is set to be equal to the length R of insertion portion 6 shown in FIGS. 1 to 3.

The guide lands 4 shown in FIG. 4 are formed by cutting or squeezing opposite sides of the wall of peripheral edge 2 so as to narrow the transverse span of the body 1. In this case, the side of peripheral edge 2 on which guide land 4 is formed suitably has an increased wall thickness to provide for the cut or squeezed portion. Further, it is possible to form the top or only one side of peripheral edge 2 with a guide land 4.

UTILITY OF THE INVENTION

Figure 5:
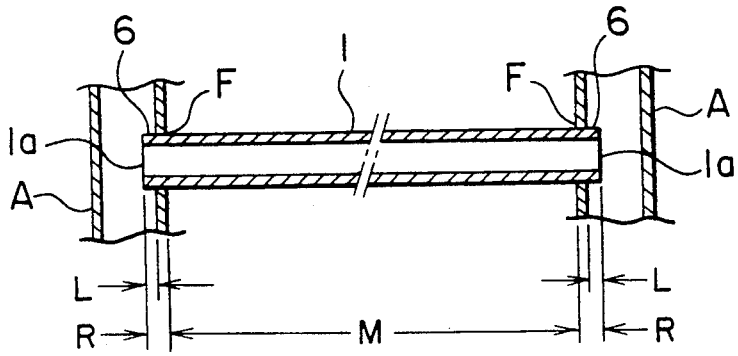
FIG. 5 is a section view through a portion of a condenser, illustrating how the heat exchange tube of the present invention is inserted into pipes.
Figure 6:
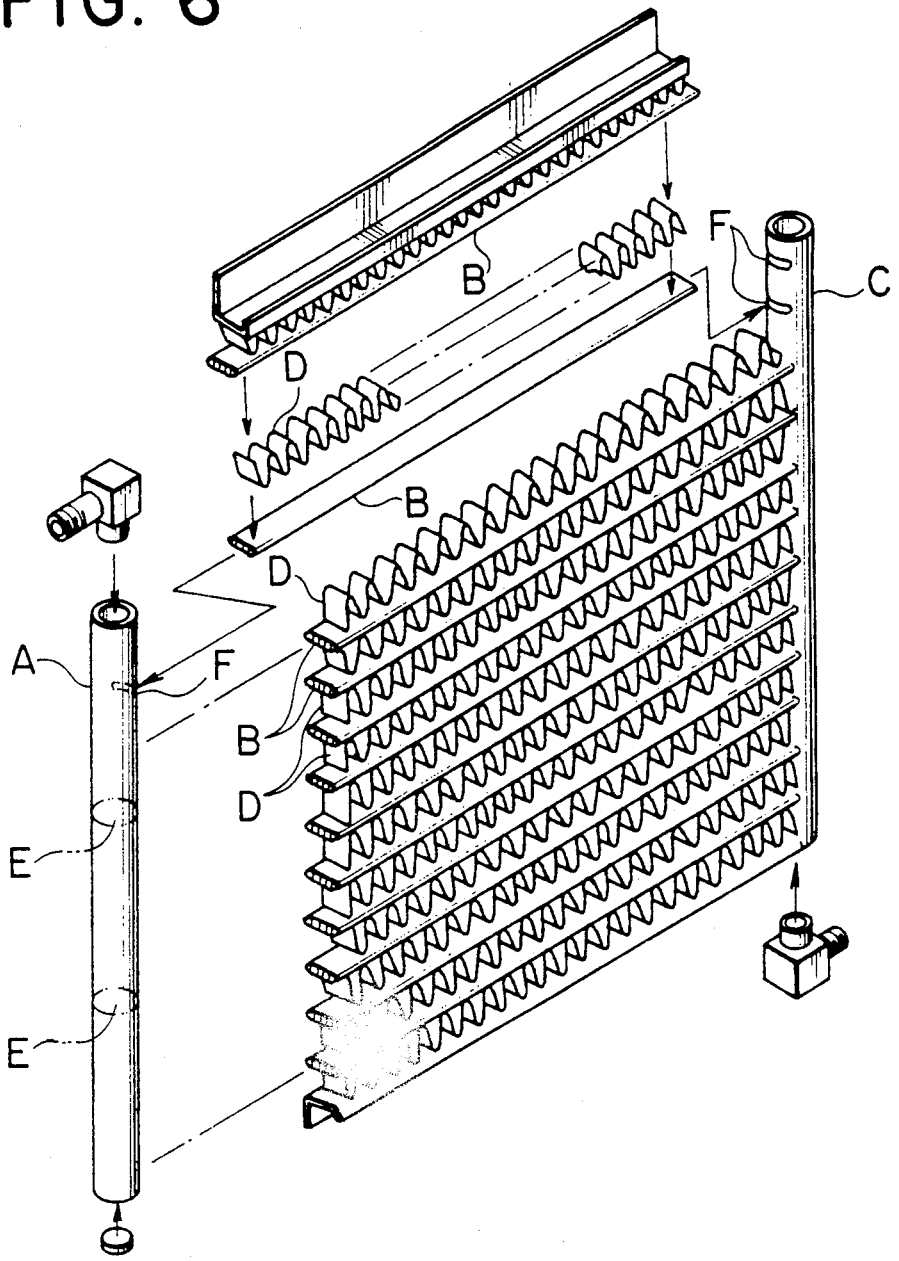
FIG. 6 is a view showing a prior art coolant condenser.
Figure 7:
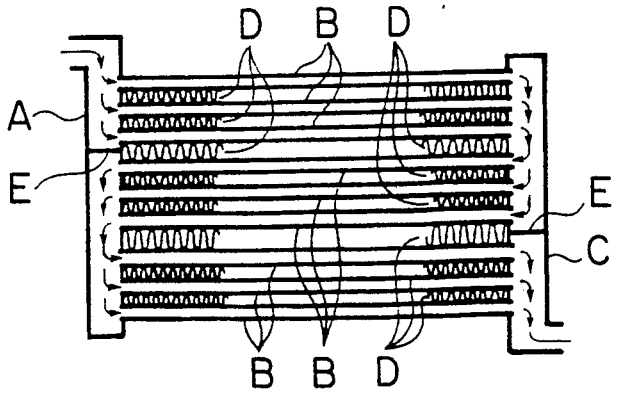
FIG. 7 is a view illustrating the flow of coolant in the coolant condenser of FIG. 6.
Figure 8:
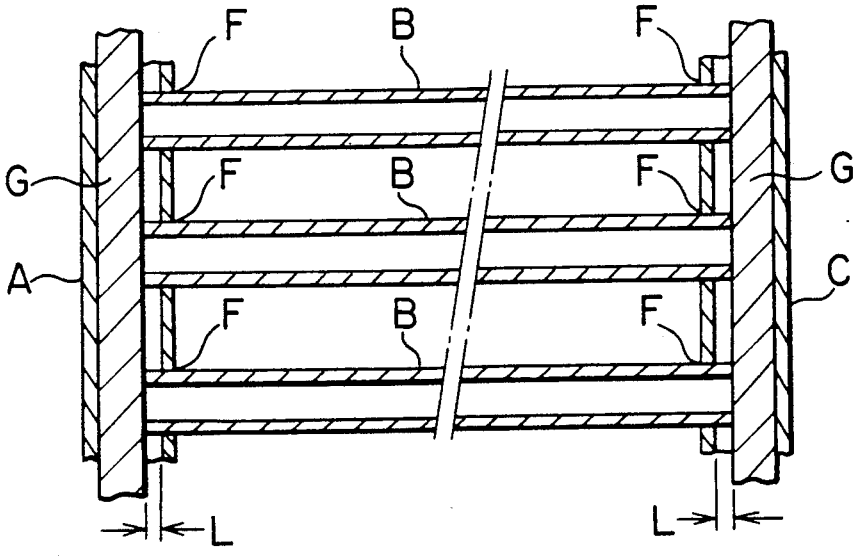
FIG. 8 is a sectional view illustrating the insertion of tubes in the prior art coolant condenser.

In use, after inserting the end portions 6 of the heat exchange tube body 1 into the slots F of the header pipe A as shown in FIG. 5, the tube is fixedly secured by soldering. The portions of the header pipe A and tube body 1 which are soldered are preliminarily coated with solder, and heated so that the solder is fused to effect firm and fixed attachment.

With the heat exchange tube shown in FIGS. 1 to 3 in which peripheral edge 2 of tube body 1 is formed with outwardly projecting shoulders 3. The tube body 1 can be automatically positioned by merely inserting it into the slots F of the header pipe A until the shoulders 3 strike the peripheral wall of header pipe A, thus providing constant insertion length L of tube body 1 into pipe A (FIG. 5).

With the heat exchange tube for a coolant condenser shown in FIG. 4, when the heat exchange tube body 1 has its insertion end portions 6 formed with guide lands which extend outwardly less than the remainder 7 of the body, insertion of end portions 6 into slots F is facilitated. Further, once the shoulders 3 strike against the peripheral surface of the header tube, the heat exchange body 1 is automatically positioned as shown in FIG. 5. In this manner, a constant insertion length L is obtained.

ADVANTAGES OF THE INVENTION

With the heat exchange tube for a coolant condenser according to the invention, which has insertion length stop shoulders 3, the following advantages can be obtained:

1) Merely inserting tube body 1 into the insertion holes F of the header pipe A provides for a fixed insertion length L of tube body 1 into pipe A and eliminates without fluctuations in coolant flow.

2) The tube body 1 is less likely to be deviated before or during the soldering operation or after its insertion into slots F.

3) Since the insertion length L of tube body 1 into pipe A is fixed, the resistance offered against flow of coolant in header pipe A and rate of flow of coolant into tubes B are stabilized to obtain a coolant condenser having stable cooling efficiency.

4) With the tube shown in FIG. 4, which has guide lands 4, the insertion of tube body 1 into tube insertion holes F of pipe A is more easily facilitated.

We claim:

1. In a coolant condenser having a pair of header pipes spanned by a plurality of heat exchange tubes having ends of predetermined length inserted in slots in the header pipes, the improvement wherein said heat exchange tubes comprise a flat tubular body having an elongated rod extending in length along at least one peripheral edge of said body between the predetermined length ends thereof, said rod terminating at each of its ends in a shoulder projecting outwardly from said body to strike the surface of said associated header pipe adjacent the slot into which said end is inserted to thereby limit the insertion of said heat exchange tube in said associated header pipe to said predetermined length.

2. The improvement according to claim 1, wherein said rod is integrally formed with said body.

3. The improvement according to claim 1, wherein said rod is separately formed and attached to said body.

4. The improvement according to claim 1, wherein each side of said body is provided with said rod.

5. In a coolant condenser having a pair of header pipes spanned by a plurality of heat exchange tubes having ends of predetermined length inserted in slots in the header pipes, the improvement wherein said heat exchange tubes comprise a flat tubular body of greater width than said slot, said predetermined length ends being formed by cutting the peripheral edges of said body parallel to said peripheral edges so that said predetermined length end is narrower in the width than the remainder of said bodies and the frontal edge of said larger portion of said body being adapted to form a shoulder projecting outwardly from said body to strike the surface of said associated header pipe about the slot into which said predetermined length end is inserted to thereby limit the insertion of said heat exchange tube in said associated header pipe to said predetermined length.

6. The improvement according to claim 5, wherein the reduced portion of said body is formed by cutting the peripheral edges.

7. The improvement according to claim 5, wherein said reduced end portion of said body is formed by compressing said body laterally of its length.

8. In a coolant condenser having a pair of header pipes spanned by a plurality of heat exchange tubes having ends of predetermined length inserted in slots in the header pipes, the improvement wherein said heat exchange tubes comprise a flat tubular body, said body being compressed in a plane perpendicular to the plane of the tubular body to deform the material of the body and provide an outwardly projecting member adapted to strike against the surface of the header pipes when the predetermined length is inserted in said slots.

* * * * *